US009926182B2

(12) United States Patent
Santy

(10) Patent No.: US 9,926,182 B2
(45) Date of Patent: Mar. 27, 2018

(54) BEVERAGE DISPENSING SYSTEM HAVING ELECTRIC PUMPS AND A REMOVABLE TRAY FOR HOLDING CONCENTRATE BAGS

(71) Applicant: SCHROEDER INDUSTRIES, INC., San Antonio, TX (US)

(72) Inventor: David Santy, Converse, TX (US)

(73) Assignee: Schroeder Industries, Inc., San Antonio, TX (US)

( * ) Notice: Subject to any disclaimer, the term of this patent is extended or adjusted under 35 U.S.C. 154(b) by 116 days.

(21) Appl. No.: 14/715,353

(22) Filed: May 18, 2015

(65) Prior Publication Data

US 2015/0329342 A1 Nov. 19, 2015

Related U.S. Application Data

(60) Provisional application No. 61/994,915, filed on May 18, 2014.

(51) Int. Cl.
*B67D 1/10* (2006.01)
*B67D 1/12* (2006.01)
(Continued)

(52) U.S. Cl.
CPC ..... *B67D 1/1222* (2013.01); *B67D 1/004* (2013.01); *B67D 1/0022* (2013.01);
(Continued)

(58) Field of Classification Search
CPC .... B67D 1/0021; B67D 1/004; B67D 1/0078; B67D 2001/0087; B67D 2001/0089; B67D 2001/0091; B67D 2001/0097; B67D 1/06; B67D 2001/0827; B67D 1/0889; B67D 1/10; B67D 1/1245; B67D 3/0016; B67D 3/0019; B67D 3/0054; B67D 3/0067; B67D 3/008; B67D 3/0083; B67D 3/0087; B67D 7/58; B67D 7/84; B67D 2210/00031; B67D 1/0891; B67D 2210/0006
See application file for complete search history.

(56) References Cited

U.S. PATENT DOCUMENTS 2,666,548 A * 1/1954 Lund ..... B67D 1/0021 220/378
3,402,854 A * 9/1968 Marchetti ..... B67D 1/0021 222/129.1
(Continued)

*Primary Examiner* — Patrick M Buechner
(74) *Attorney, Agent, or Firm* — Jackson Walker, LLP

(57) ABSTRACT

Various systems, processes, and techniques may be used to achieve beverage dispensing. In particular implementations, a beverage dispensing system may include a housing, a water inlet, a dispensing faucet, and a tray. The housing may include a base and at least one vertically extending wall that defines an inner cavity at least at the top of the housing. The water inlet and the dispensing faucet may be coupled to the housing. The tray may be adapted to couple to the housing and be suspended in the inner cavity. The tray may have walls and a lower surface that define a cavity adapted to hold a beverage concentrate container, the lower surface being slanted relative to the base of the housing when the tray is coupled to the housing. The lower surface may have an connector fitting adapted to receive a beverage concentrate conduit.

18 Claims, 13 Drawing Sheets

(51) Int. Cl.
*B67D 1/00* (2006.01)
*B67D 1/08* (2006.01)

(52) U.S. Cl.
CPC ..... *B67D 1/0036* (2013.01); *B67D 1/0046* (2013.01); *B67D 1/0078* (2013.01); *B67D 1/0891* (2013.01); *B67D 1/10* (2013.01); *B67D 1/1206* (2013.01); *B67D 2210/0006* (2013.01); *B67D 2210/00031* (2013.01)

(56) References Cited

U.S. PATENT DOCUMENTS 3,435,990 A * 4/1969 Pike, Jr. ..... B67D 1/0001 222/1
3,830,405 A * 8/1974 Jaeger ..... B67D 1/0021 222/129.3
4,632,275 A * 12/1986 Parks ..... B67D 1/0021 222/129.1
4,708,266 A * 11/1987 Rudick ..... B67D 1/0036 222/105
4,709,835 A * 12/1987 Kruger ..... B67D 3/0003 222/541.6
4,856,676 A * 8/1989 Emody ..... B67D 1/0021 137/240
5,491,617 A * 2/1996 Currie ..... B67D 1/06 222/113
6,554,164 B1 * 4/2003 Jones ..... B65D 77/068 222/105
6,708,741 B1 * 3/2004 Berry ..... B67D 3/0009 141/351
2002/0125268 A1 * 9/2002 Bertone ..... B67D 1/0006 222/4
2006/0249536 A1 * 11/2006 Hartman ..... B67D 1/0004 222/129.3
2007/0131711 A1 * 6/2007 Minard ..... B65D 21/0223 222/105
2009/0008407 A1 * 1/2009 Sevcik ..... B67D 1/0021 222/1
2014/0252031 A1 * 9/2014 Norris ..... B67D 3/0029 222/105

* cited by examiner

BEVERAGE DISPENSING SYSTEM HAVING ELECTRIC PUMPS AND A REMOVABLE TRAY FOR HOLDING CONCENTRATE BAGS

RELATED APPLICATIONS

This application claims the benefit of and priority to U.S. Patent Application No. 61/994,915, filed May 18, 2014. This prior application is herein incorporated by reference.

BACKGROUND OF THE INVENTION

Food service establishments (e.g., restaurants or convenience stores) often make non-carbonated beverages (e.g., tea or fruit juice) by using dispensing systems that mix beverage concentrates, usually in the form of a syrup, with water. Dispensing systems that use bag-in-box concentrate (or just concentrate in a flexible bag) typically store the concentrate at a remote location. The concentrate is brought to the dispensing machine via pumps in the dispensing system and long conduits. In a few dispensing mechanisms, the bag is "on-board," meaning within the dispenser housing. There are a number of ways in which to store on-board bags, but, in changing out the bags when they were depleted or when a flavor change was desired, leakage can cause a mess. Moreover, in prior art on-board bag systems, access was often a problem. Tools or wall removal was required for obtaining access to the bags. Not only is access a problem in such systems, that is access to the concentrate, but the location and member which supported such concentrate also presented problems in getting access to other elements of the beverage dispensing system.

SUMMARY OF THE INVENTION

Various systems, processes, and techniques for dispensing beverages are disclosed. In certain implementations, a beverage dispensing system may include, among other things, a housing, a water inlet, a dispensing faucet, and a beverage storage tray. The housing may have a base and at least one vertically extending wall that define an inner cavity at least at the top of the housing. The water inlet and the dispensing faucet may be coupled to the housing. The tray may be adapted to couple to the housing and be toollessly engaged so as to be suspended in the inner cavity. The tray may have walls and a lower surface that define a cavity adapted to hold one or more beverage concentrate containers (such as a bag or a bag in a box). The lower surface of the tray may be slanted, from an elevated portion to a lower portion, relative to the base of the housing when the tray is coupled to the housing. The lower surface may have a through the floor connector fitting including an aperture adapted to receive a beverage concentrate conduit.

In certain implementations, the connector fitting is in the elevated portion of the lower surface of the tray. A container connector fitting may be located in the lower portion. The connector fitting may include a quick disconnect for a beverage hose.

In particular implementations, the housing is adapted and dimensioned to sit on a counter. The system may also include an electric pump or pumps adapted to draw beverage concentrate from a bag located in the tray. In certain embodiments, there are 24 VDC pumps, with the DC being supplied by a remote wall mounted transformer Various implementations may include one or more features. For example, by using a slanted beverage storage tray, additional beverage concentrate may be extracted from a container (e.g., a bag). Additionally, storing the beverage locally may allow the system to be used where beverage supply lines (e.g., from a back room) are not available.

A variety of other features will be apparent to one skilled in the art from the following detailed description and claims, along with the accompanying drawings.

BRIEF DESCRIPTION OF THE DRAWINGS

FIGS. 1A-H are perspective views of an example beverage dispensing system.

DETAILED DESCRIPTION OF THE PREFERRED EMBODIMENT

Figure 1A:
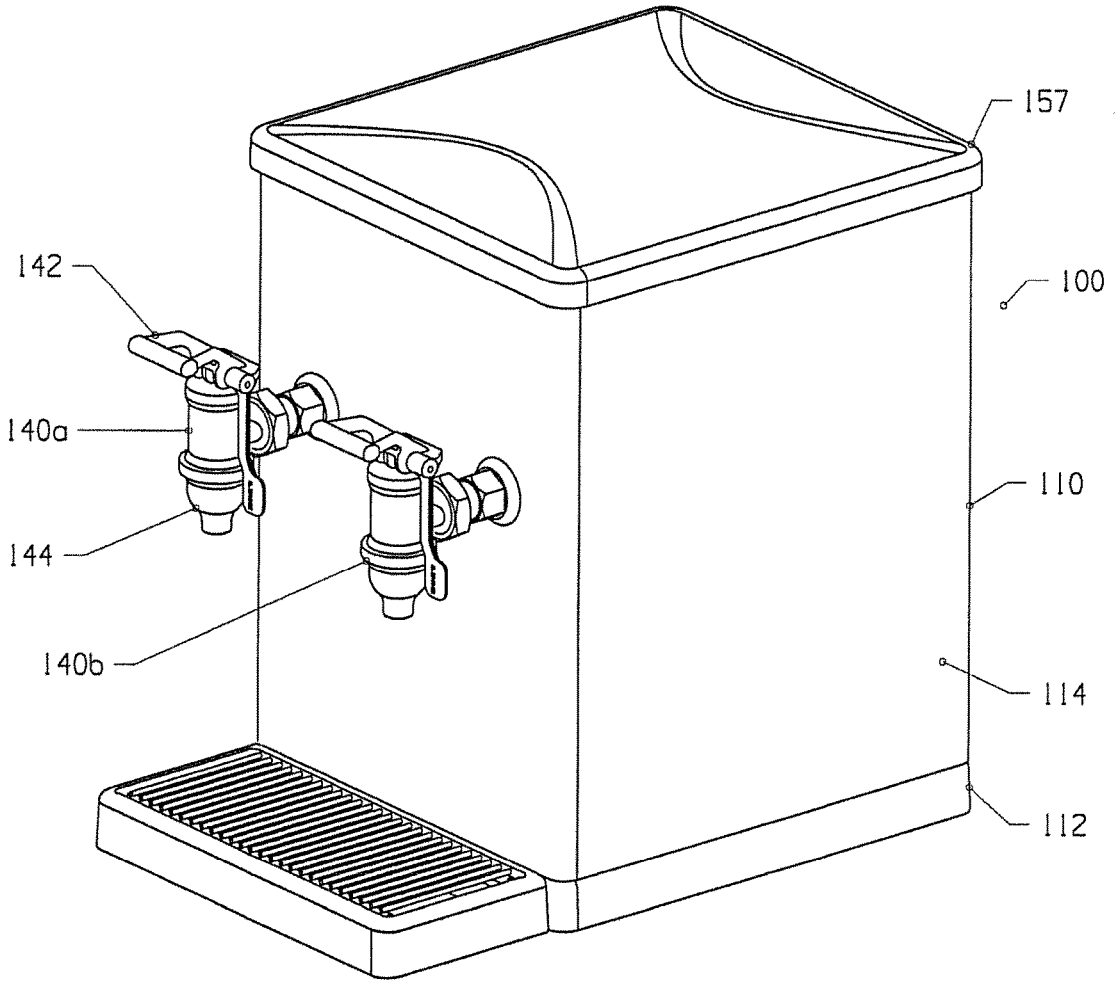
Figure 1B:
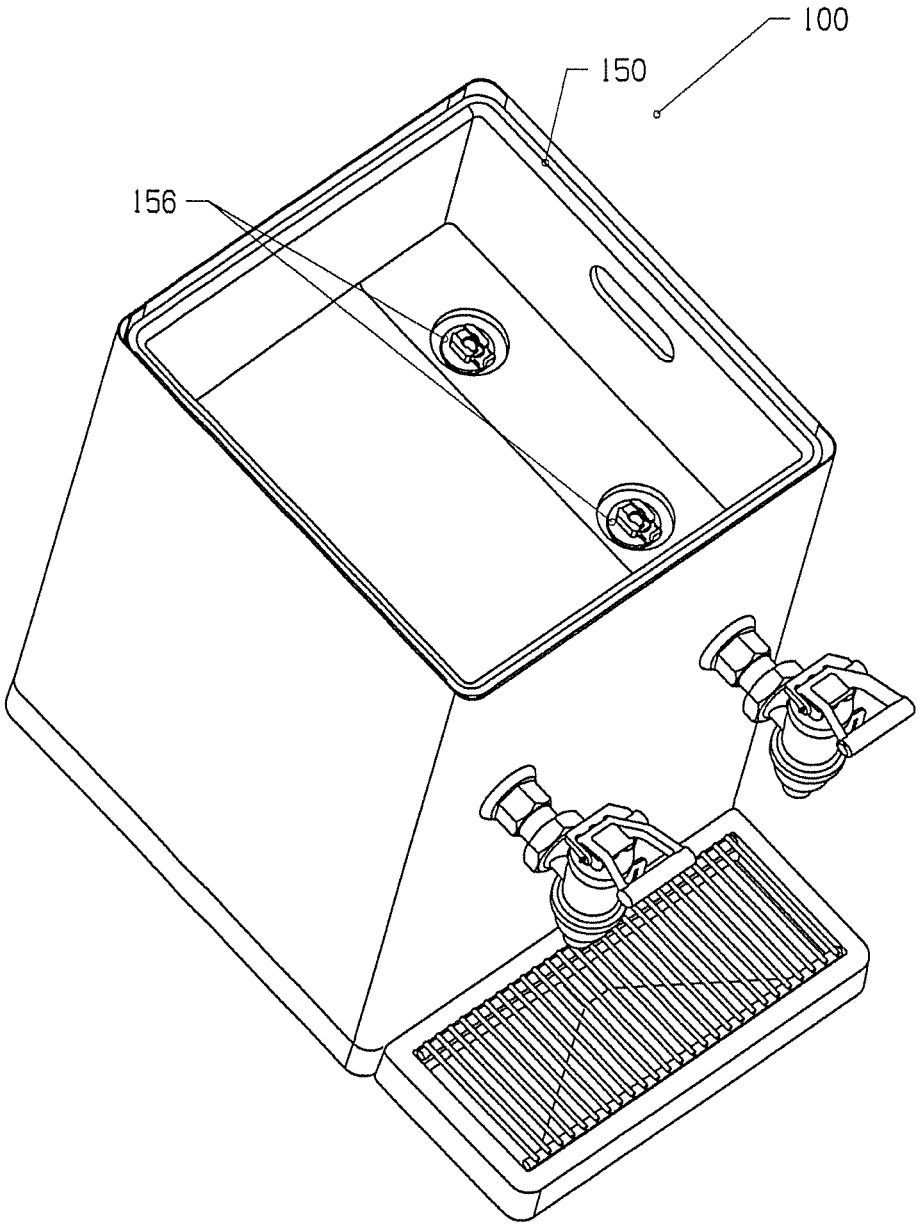
Figure 1C:
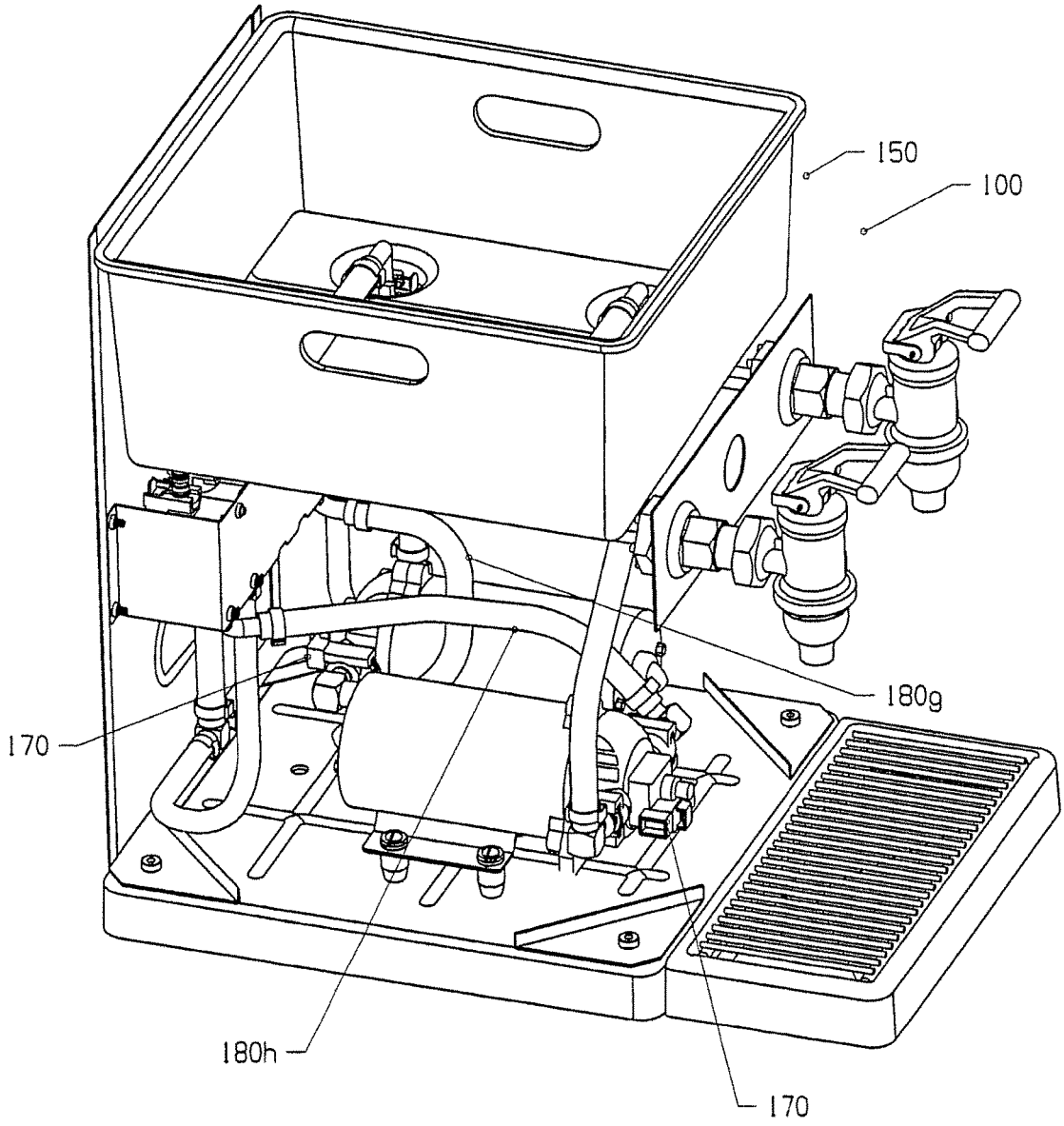

FIGS. 1A-H illustrate an example multiple station (here two station) beverage dispensing system 100. System 100 includes, among other things, a housing 110, a water inlet assembly 120 (FIG. 1E), a flow controller assembly 130 (FIG. 1E), multiple dispensing faucets or valves 140 (each defining a station, see FIG. 1A), a beverage storage tray 150, electric pumps 160, and pressure switches 170 (FIG. 1C).

Housing 110 includes a base 112 and vertically extending sidewalls 114. Base 112 and vertically extending sidewalls 114 define a cavity 116. Housing 110 may be made of metal, plastic, or any other appropriate material. In particular implementations, housing 110 is sized to sit on a counter.

Water inlet assembly 120 includes a connector 122 for coupling to a rear wall and coupling to a pressurized water source. The water source may be local to system 100 or remote (e.g., a public water supply). Water inlet assembly 120 may be adapted to receive water at a standard operating pressure (e.g., 30-130 psi). Water inlet assembly 120 may be made of brass, stainless steel, plastic, or any other appropriate material.

Water inlet assembly 120 also includes a manifold "T," or divider 124 (see FIGS. 1E and 1H) for dividing water into two or more parts for flow controller assembly 130. Divider 124 is coupled to connector 122 by a conduit 180*a*. Conduit 180*a*, along with other conduits 180 in system 100, may be a hose, a tube, a pipe, or any other appropriate device for conveying fluid. Conduits 180 may be made of metal, rubber, plastic, silicone-rubber, or any other appropriate material.

In certain implementations, water inlet assembly 120 may include a shut-off valve (not shown). A shut-off valve may, for example, be a ball valve, a butterfly valve, or any other device for controllably restricting fluid flow.

Figure 1D:
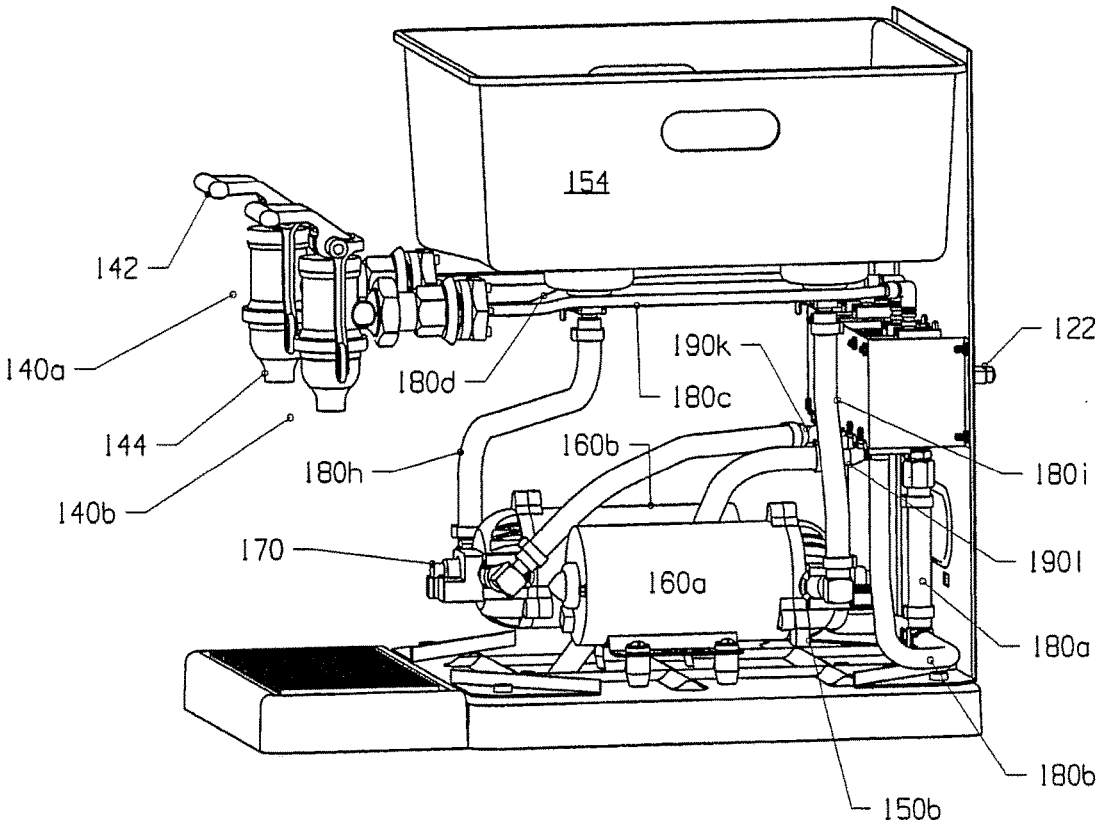
Figure 1E:
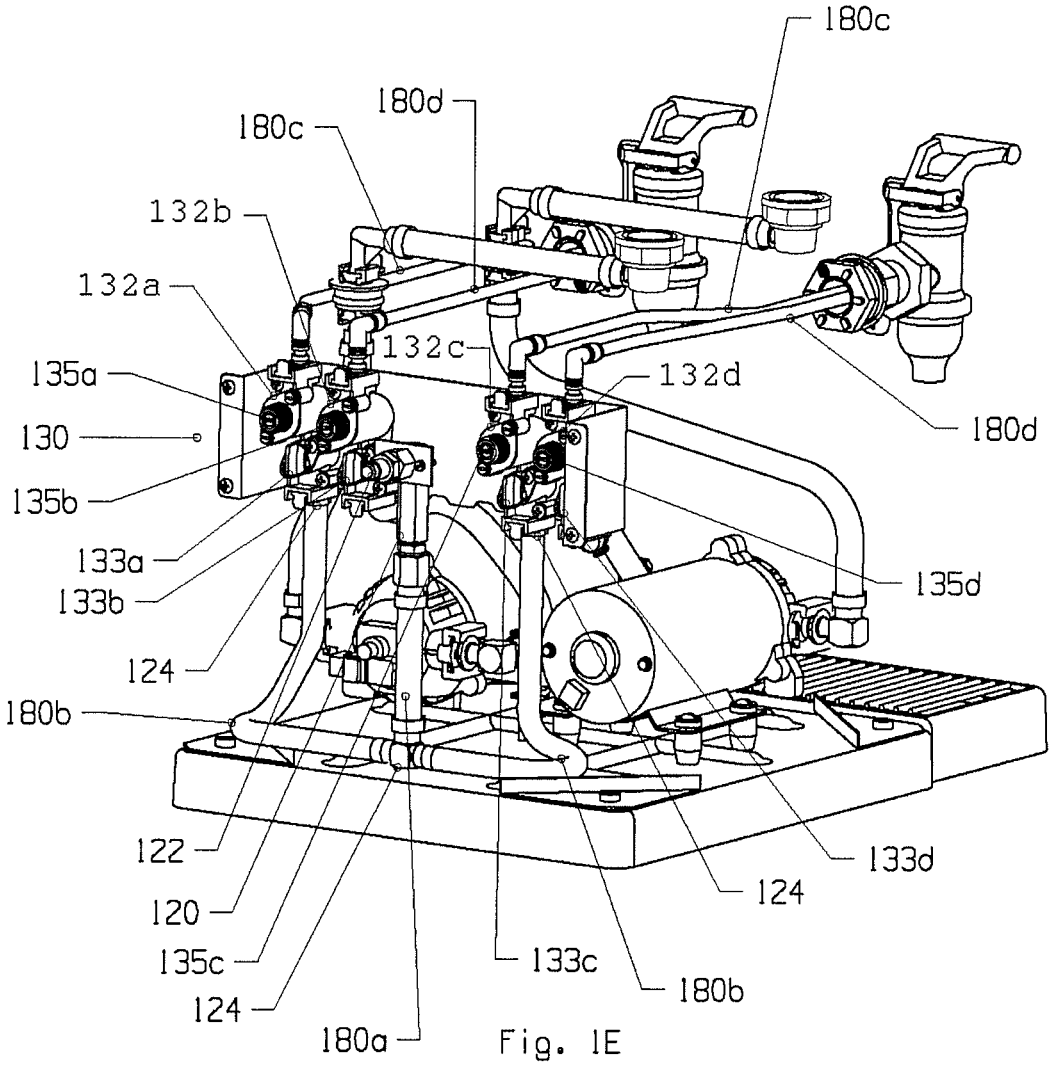

FIG. 1E illustrates the manner in which flow controller assembly 130 is coupled to water inlet assembly 120 at two locations. In the illustrated implementation, flow control assembly 130 includes four flow controllers 132*a-d*, two for each of the two beverage types (one at each station). Flow controllers 132*a-d* regulate the flow rate of water and beverage concentrate through system 100 during dispensing operations. In certain implementations, the beverage concentrate may be in the form of a syrup. In particular implementations, flow controllers 132*a-d* may regulate the flow rates to between about 0.2 ounces/s to 3.0 ounces/s. As part of regulating flow, flow controllers 132*a-d* may maintain fairly constant flow rate even as upstream pressure changes. In certain implementations, flow controllers 132*a-d* may operate exclusively by mechanical techniques. Thus, flow controllers 132*a-d* may require no electricity. In particular implementations, flow controllers 132*a-d* may be similar to the 139-0030/Valve Assy/Cntl, Soda 1 flow controller available from Schroeder America of San Antonio, Tex. (USA).

Flow controllers 132*a-d* may be adapted to operate under relatively high pressures. Public water supplies typically have pressure between 30-80 psi, but some go up to 130 psi. Thus, flow controllers 132*a-d* may be designed to work with pressures up to 80 psi and, in certain implementations, up to 130 psi. The 139-0030/Valve Assy/Cntl, Soda 1 flow controller available from Schroeder America, for example, is able to operate under those pressures.

In certain implementations, flow controller assembly 130 may include one or more shut-off valves 133*a-d* (133*d* being partly hidden in FIG. 1E). Shut-off valves 133 may, for example, be ball valves, butterfly valves, or any other device for controllably restricting fluid flow. Shut off valves 133 may be upstream of the flow controllers 132.

Figure 1F:
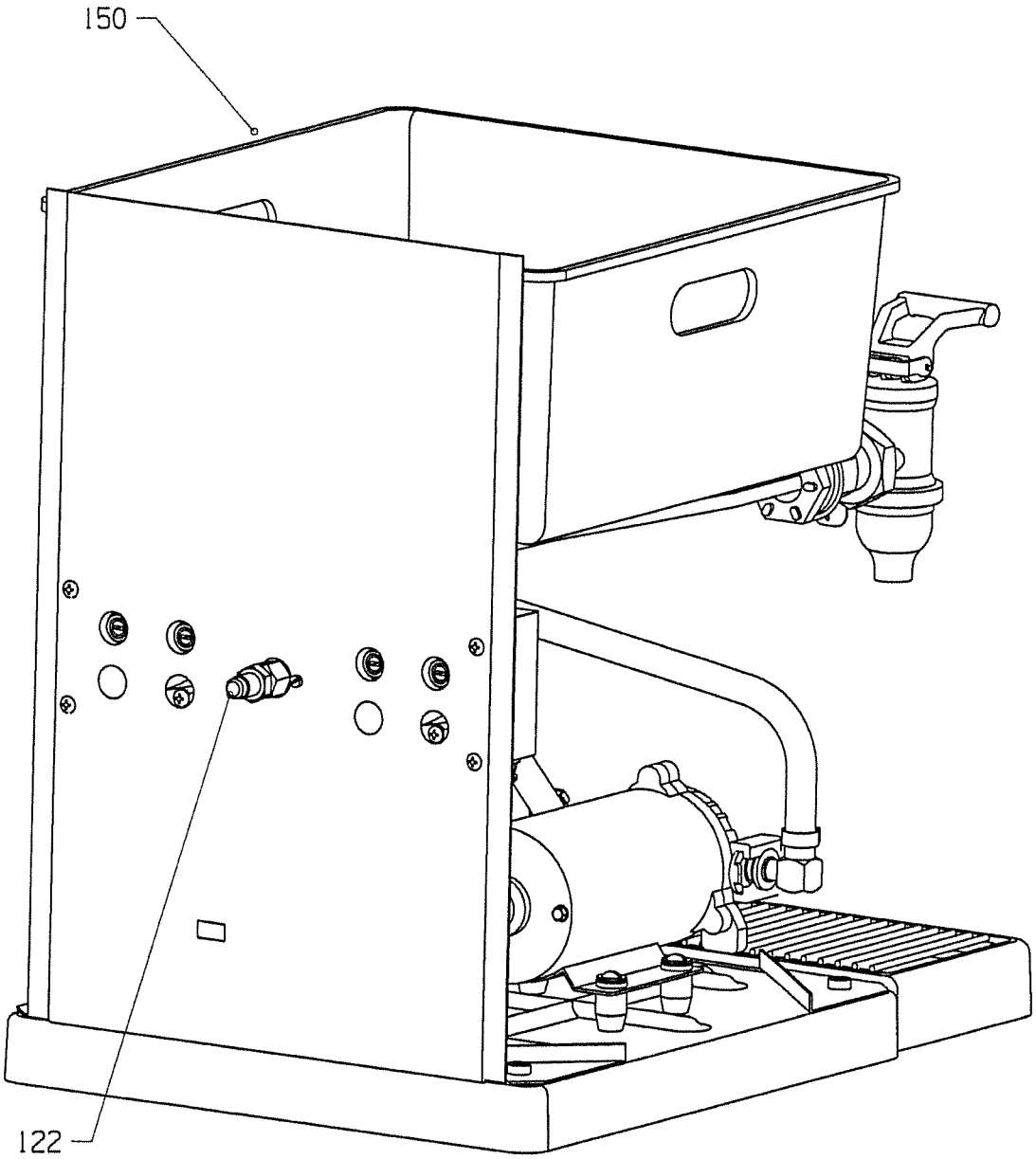
Figure 16:
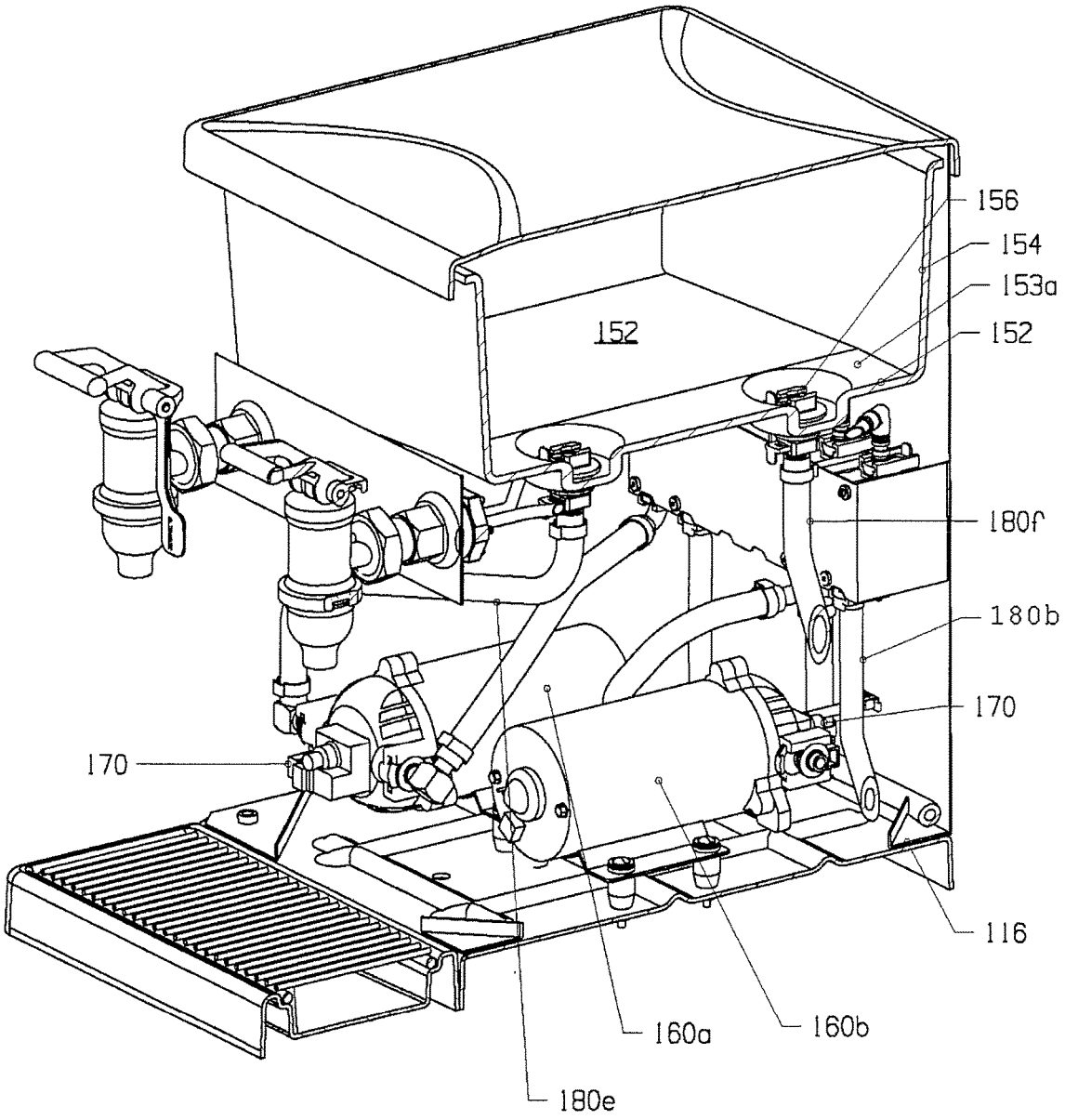
Figure 1H:
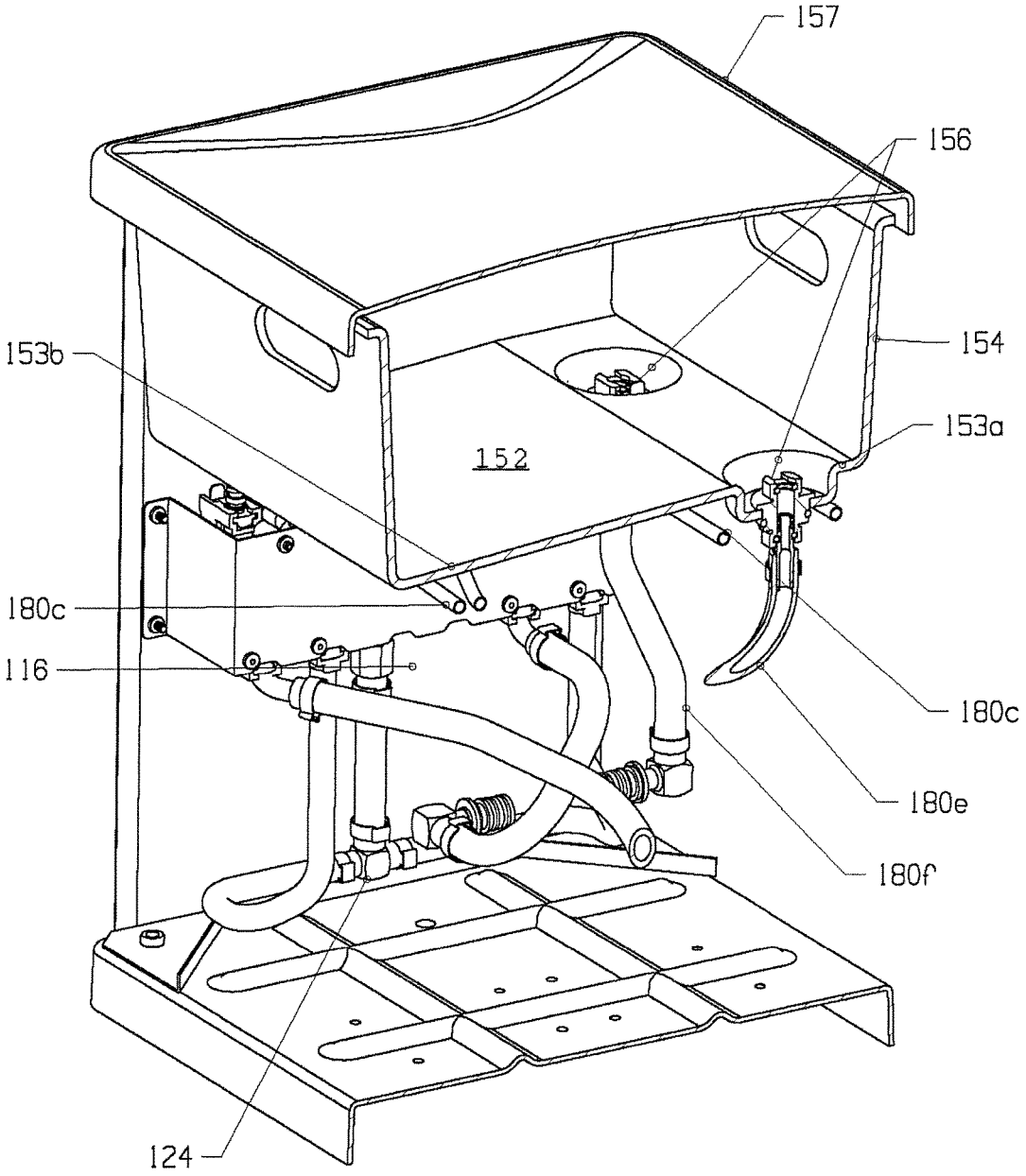

Flow control assembly 130 also includes flow control adjusters 135*a-d*, to adjust the flow through flow controllers 132. In the illustrated implementation, flow control adjusters 135 include slotted heads for receipt of a screw driver, which may be inserted through holes in the rear wall of housing 110 (FIG. 1F).

Flow controller assembly 130 is coupled to dispensing valves 140 through conduit pairs 180*c-d*. Each dispensing faucet or valve 140 receives a pair of conduits 180*c* and 180*d*, one for water and one for beverage concentrate.

Dispensing faucets 140*a-b* (FIG. 1D) (such as post-mix valves shown) combine water with beverage concentrate, such as tea, coffee, fruit juice, soda syrup, or any other appropriate non-carbonated or carbonated beverage, to yield a finished beverage. A beverage concentrate syrup typically has a viscosity substantially higher than that of water.

Each dispensing faucet 140*a-b* includes a handle 142 and a nozzle 144. Handle 142 is mechanically operated and serves as a lever to activate a valve (not viewable) inside the dispensing valve. The valve may, for example, be a poppet valve or any other appropriate type of valve. If pressures are not too high, a pinch valve, for instance, could be used. A variety of other appropriate faucets are described in U.S. patent application Ser. No. 12/944,457, which is entitled "A Post-Mix Dispenser Assembly," was filed on Nov. 11, 2010, and is herein incorporated by reference.

Dispensing faucets 140 may be able to withstand relatively high pressures (e.g., above 30 psi), and in some implementations may be able to withstand pressures up to 140 psi, without leaking. In particular implementations, dispensing faucets 140 may be similar to the 137-0005, Assy, Valve, Post Mix dispensing faucets available from Schroeder America of San Antonio, Tex. (USA). Dispensing faucets 140 may be made from metal, plastic, or any other appropriate material.

As seen in FIGS. 1B, 1D, 1G, and 1H, in system 100, the various flavored beverage concentrates are stored in bags (or bag in box) that rest in beverage storage tray 150. Beverage storage tray 150 includes a bottom 152 and one or more side walls 154. As illustrated, bottom 152 is in some embodiments slanted relative to base 112. Thus, bottom 152 may have an elevated end 153*a* and a lower end 153*b* (see FIG. 1H).

Figure 6:
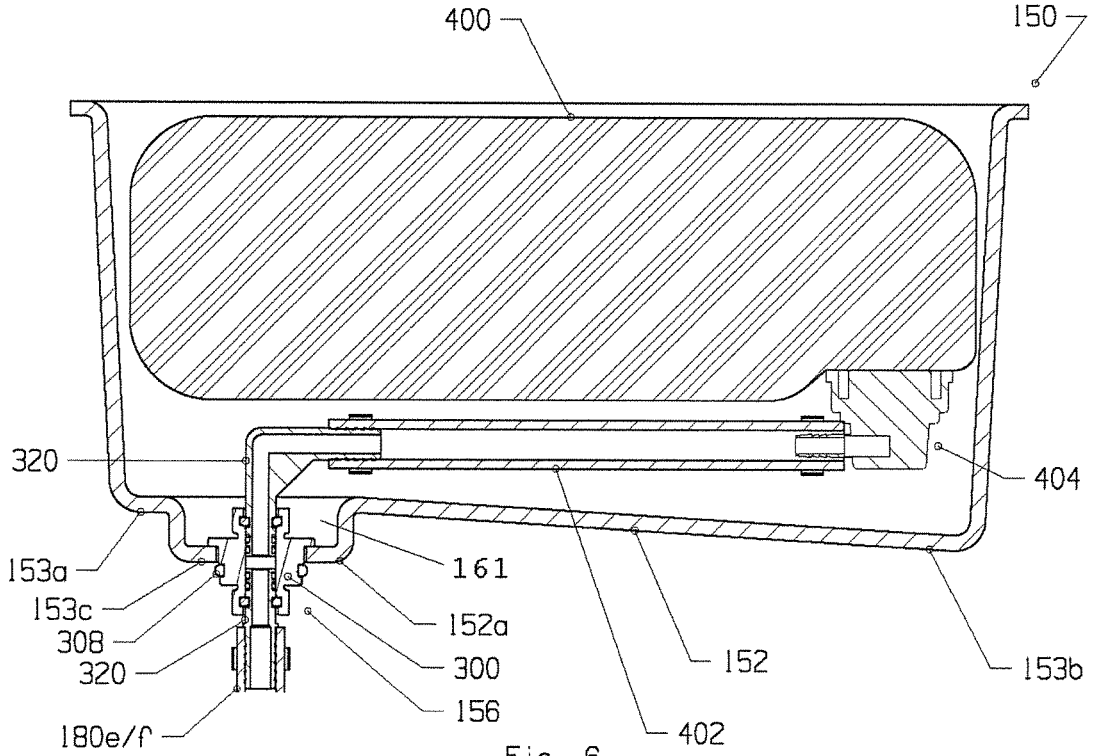
FIG. 6 is a cross section of the tray showing the relationship between the fluid fitting bag connector and tray bottom.

As seen in FIG. 1G and FIG. 6, beverage storage tray 150 also includes multiple quick disconnect, through the tray floor fluid connector fittings 156, one for each beverage concentrate bag 400 engaged with the floor of the tray. Each quick disconnect fitting 156 includes two disconnect portions, one for conduits 402, which run to bags 400, and one for conduits 180*e-f*, which run to electric pumps 160*a-b* (FIG. 1G). The conduits that run to the quick disconnects 156 may include dole fittings 320 (an upper and a lower, see FIG. 3) for coupling conduits 402 to the quick disconnect fittings 156 (upper) and conduits 180*e/f* to the quick disconnect fittings 156 (lower). From dole fitting 320, a conduit 402 may run to bag 400, where it is coupled to the bag connector 404 (e.g., a connector similar to the 15F01119IH Bib Connector of the QCD 2 #400137 connector available from Liquid Box of Worthington, Ohio (USA)). Any number of industry standard bag connectors 404 may be used. In certain implementations, the conduit may include a 90 degree bend (see FIG. 3) near dole fitting 320.

Bags or bag in boxes may be placed in beverage storage tray 150 so that their connectors 404 are in lower end 153*b*. Thus, as the beverage concentrate is extracted from the bags, the syrup will, under gravity, move towards the connectors 404. This should allow more beverage concentrate to be extracted from each bag. Industry estimates are that up 10% of each bag of beverage concentrate is wasted.

As mentioned previously, and as seen in FIG. 1G, from the bottom of each quick disconnect fluid connector 156, conduits 180*e/f* carry beverage concentrate to respective ones of pumps 160*a-b*. Pumps 160*a-b* may be conventional electrical pumps, operating on AC or DC power. In particular implementations, alternating current (AC) power may be converted to direct current (DC) power before entering housing 110 for safety purposes. Pumps 160*a-b* pump beverage concentrate toward dispensing valves 140*a-b*. Appropriate pumps are well known to those of skill in the art.

As seen in FIGS. 1C and 1D, built into pumps 160*a-b* and in line with flow controller assembly 130 are pressure switches 170. Pressure switches 170 are able to detect a drop in pressure (e.g., due to one of dispensing valves 140 being opened) and instruct the associated pump to activate. Pressure switches 170 in another embodiment may not be "built in" to the pumps, but are coupled to pumps 160 through conduits. Appropriate pressure switches are well known to those of skill in the art.

Each of pressure switches 170 is fluidly coupled to one of the flow controllers 132 in flow controller assembly 130. Thus, the beverage concentrates pumped by fluid pumps 160 are regulated for flow rate before proceeding to dispensing valves 140.

In certain modes of operation, beverage concentrate containers (e.g., bags) are coupled to conduits running to the quick disconnect fittings 156 and placed in beverage tray 150. A cover 157 (e.g., a lid) (see FIG. 1H) may then be placed over housing 110 (enclosing cavity 116).

Additionally, a water supply is coupled to water inlet assembly 120. Dispensing valves 140, which may, for example, be a post-mix valve, are then opened by activating handles 142 (either one at a time or simultaneously) to allow water and a beverage concentrate to flow therethrough. Flow controllers 132 on each water and beverage circuit regulate the flow of water and beverage concentrate in known ways to a prescribed flow rate and supply it to dispensing valves 140.

When the handle of a dispensing valve 140 is activated, water flows through the dispensing valve due to the pressure from the water supply. Additionally, beverage concentrate syrup flows through the dispensing valve due to pressure in one of conduits 180*e* and *f* (fitting to pump), one of conduits 180*g* and *h* (pump to flow control), and one of conduits 180*d* (flow control to dispensing valve). When the associated pressure switch 170 detects a drop in pressure, the switch activates the associated pump 160 to supply additional beverage concentrate. The beverage concentrate is mixed together with the water, at least initially, in the nozzle 144 of the associated dispensing valve 140*a/b*.

In certain implementations, the dispensed beverage may be chilled. For example, chilled water may be fed through water inlet assembly 120 or a chilling unit may be placed inside housing 110. Since water is mixed with the beverage concentrate in a ratio of between about 5:1 to 10:1, this will chill the dispensed beverage. In particular implementations, however, the concentrated beverage syrup may also be chilled (e.g., by pre-chilling before reaching housing 110 or refrigerating housing 110).

System 100 has a variety of features. Previous beverage dispensing systems used remote pumps and beverage bags to supply beverage concentrate to a beverage dispenser. However, as the number of beverages has begun to expand greatly, the conduits to carry the beverages from a back room to the dispenser have been used up. With system 100, however, the beverage concentrate is local with the housing. Thus, the only thing that needs to be supplied to system 100 is water, which is typically readily available, and electricity.

Although FIGS. 1A-H illustrate one example beverage dispensing system, other beverage dispensing systems in accordance with the invention may include fewer, additional, and/or a different arrangement of components. For example, a beverage dispensing system may include fewer or additional dispensing faucets. For instance, a beverage dispensing system may include one dispensing faucet. A pre-mix valve or faucet may be also used. As an additional example, a beverage dispensing system may omit flow splitter 124. As a further example, a pressure switch may not be used. Instead, for example, the dispensing valve may activate the pump (e.g., by an electrical connection) when opened. As another example, a beverage dispensing system may not use a slanted tray or the thru-the-tray quick disconnect fitting. Instead, for example, a beverage dispensing system may use a standard tray or a compartment built into housing.

Applicant's beverage storage tray 150 may also be used in other beverage dispensing systems. For example, the beverage storage tray may be used in other pump-based systems or in a Venturi-based system. In a Venturi-based system, a beverage storage tray may include additional apertures (in one implementation surrounded by bosses and/or with covers) in the bottom (e.g., to allow access for adjusting an adjustment mechanism in a Venturi device located under the tray).

Figure 2:
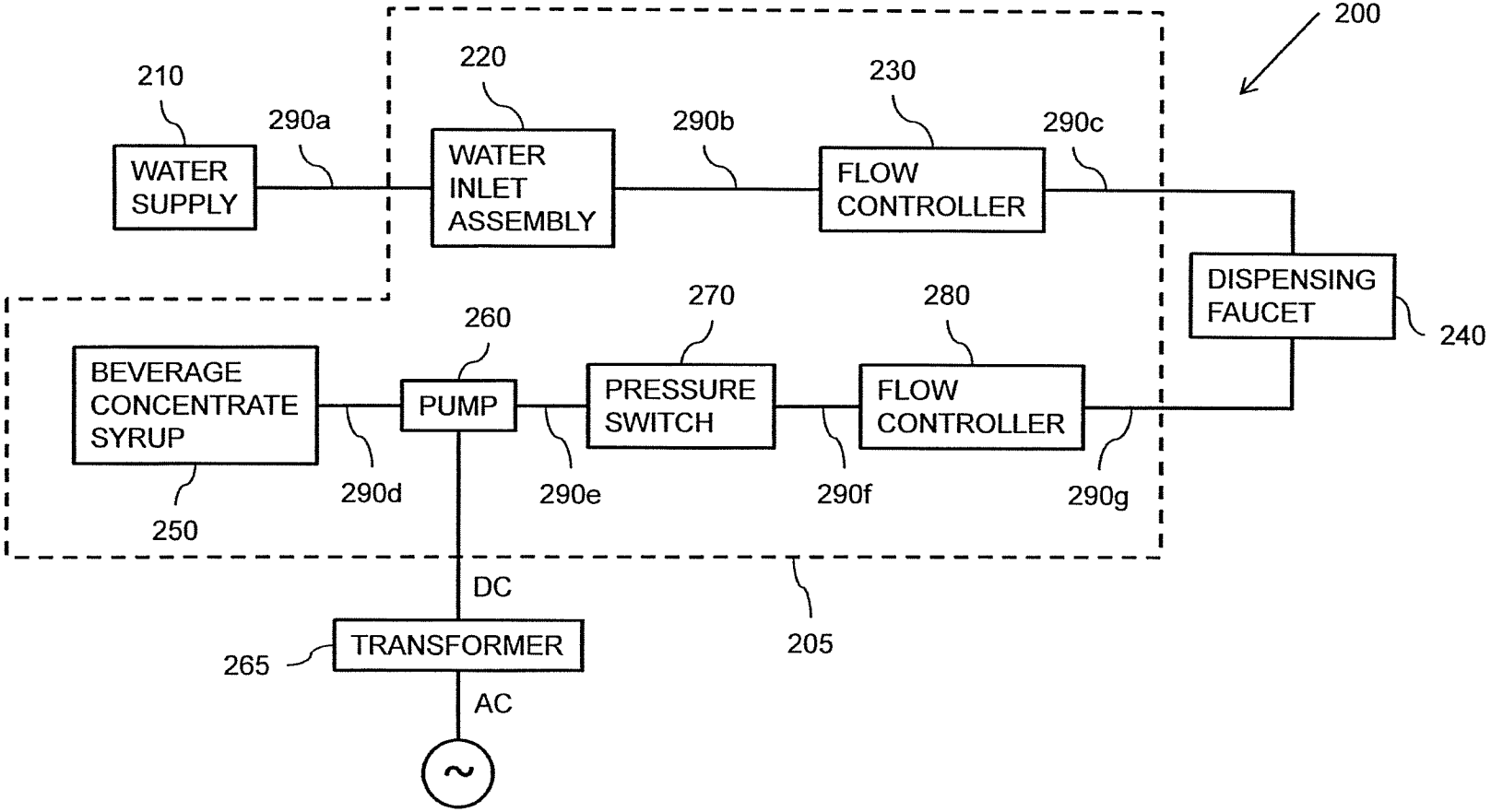
FIG. 2 is a block diagram illustrating another example beverage dispensing system.

FIG. 2 illustrates a schematic example of a beverage dispensing system 200. System 200 includes a first fluid circuit including a pressurized water supply 210, a water inlet assembly 220, a flow controller 230, and a dispensing faucet 240. A second fluid circuit includes a beverage concentrate syrup 250, a pump 260, a pressure switch 270 (which may be built into the pump), a flow controller 280, and dispensing faucet 240. The elements of the two circuits are coupled together by conduits 290*a-g*. Conduits 290*a-g* may, for example, include a hose, a tube, a pipe, or any other appropriate fluid conveyor and may made be of metal, rubber, plastic, silicone-rubber, or any other appropriate material.

In certain implementations, pressure switch 270 may be incorporated into the pump. The pump may, for example, use 24 VDC, which may, for instance, be supplied by a transformer 265, which may convert AC (e.g., 120 VAC) to DC (e.g., 24 VDC). In particular implementations, transformer 261 may be a step-down wall mount transformer.

In some implementations, all of the components, with the possible exception of water supply 210 and transformer 265, may be located in a housing 205, which may be adapted to be placed on a counter, such as a housing having dimension, about L=13", W=12", and Height=17.5". A tray dimensioned to fit within an inner cavity of the interior space defined by the walls of the housing may have dimensions in the range of about L=4.5" to 6.5", W=10" to 12" and H=1" to 2". The inner cavity is the top part of the interior space in which the tray will fit. These dimensions will allow a typical tray to hold between 1 and about 2 concentrate bags.

Water supply 210 may, for example, be local to system 200 or remote (e.g., a public water supply). Water supply 210 is coupled to water inlet assembly 220 by a conduit 290*a*.

Water inlet assembly 220 may be adapted to receive water at a standard operating pressure (e.g., about 30-130 psi). Water inlet assembly 220 may be made of brass, stainless steel, plastic, or any other appropriate material. Water inlet assembly 220 is coupled to flow controller 230 by conduit 290*b*.

Flow controller 230 regulates the flow rate of water through system 200. In particular implementations, flow controller 230 may regulate the flow rate to between about 1.0 ounces/s to 3.0 ounces/s. As part of regulating flow, flow controller 230 may maintain downstream flow rate even as pressure changes.

In certain implementations, flow controller 230 may be operated under relatively high pressures. Public water supplies typically have pressures between about 30-80 psi, but some go up to 130 psi. Thus, flow controller 230 may be designed to work with pressures up to about 80 psi and, in certain implementations, up to about 130 psi. In particular implementations, flow controller 230 may be similar to the 139-0030/Valve Assy/Cntl, Soda 1 flow controller available from Schroeder America of San Antonio, Tex. (USA).

Flow controller 230 is coupled to dispensing faucet or valve 240 by conduit 290*c*. In particular implementations, dispensing faucet 240 is able to withstand relatively high pressures (e.g., above about 30 psi), and in some implementations may be able to withstand pressures up to about 140 psi, without leaking. Dispensing faucet 240 may, for example, be a post-mix valve similar to the 137-0005 Assy, Valve, Post Mix faucet available from Schroeder America of San Antonio, Tex. (USA). An appropriate pre-mix valve may also be used. Dispensing faucet 240 may be made from metal, plastic, or any other appropriate material.

Dispensing faucet 240 also receives beverage concentrate syrup 250. The handle movement initiates simultaneous opening of the two fluid circuits within the faucet and subsequent downstream mixing of the two fluids before they leave the faucet. The beverage concentrate syrup is typically substantially mixed with the water when leaving dispensing faucet 240.

Beverage concentrate syrup 250, which typically has a viscosity substantially higher than that of water, is supplied to pump 260 through conduit 290*d*. The beverage concentrate syrup may, for example, be in a bag. Beverage concentrate syrup from pump 260, which may, for example, be an electric pump, is conveyed to pressure switch 270 through conduit 290*e*.

Pressure switch 270 is coupled to flow controller 280 through conduit 290*f*. Pressure switch 270 may detect the pressure of beverage concentrate syrup in conduit 290*f* and activate pump 260 if the pressure drops too low (e.g., when dispensing faucet 240 is open).

Flow controller 280 regulates the downstream flow rate of beverage concrete syrup through system 200. In particular implementations, flow controller 280 may regulate the flow rate to between about 0.2 ounces/s to 1.0 ounces/s. As part of regulating flow, flow controller 280 may maintain flow rate even as upstream pressure changes.

In certain implementations, flow controller 280 may be operate under relatively high pressures. For example, flow controller 280 may be designed to work with pressures up to about 80 psi and, in certain implementations, up to about 130 psi. In particular implementations, flow controller 280 may be a similar to the 139-0030/Valve Assy/Cntl, Soda 1 flow controller available from Schroeder America of San Antonio, Tex. Flow controller 280 is coupled to dispensing faucet 240 by conduit 290*g*.

In certain modes of operation, beverage concentrate syrup 250 is coupled to conduit 290*d* to fluidly couple the syrup with pump 260. Water supply 210 is also coupled to water inlet assembly 220. Dispensing faucet 240 is then opened to allow simultaneous flow of water and syrup through system 200. As the water flows through flow controller 230, the flow rate is regulated to a prescribed flow rate. Additionally, the opening of dispensing faucet 240 should cause beverage concentrate syrup 250 to start flowing through conduit 290*g* to dispensing faucet 240, where the water and syrup are mixed to form a beverage. Flow controller 280 will regulate this flow, and pump 260 will supply additional beverage concentrate when needed.

FIGS. 3, 4, 5, and 6 illustrate further details of Applicant's quick connect through the tray fluid fitting 156 and how it engages aperture 159 in bottom or floor 152 of tray 150. Quick connect fitting 156 is seen to have a cylindrical body 300 which has a central bore or aperture 302 therethrough. Sidewalls 304 of body 300 are configured to engage and fit closely adjacent walls defining aperture 159 in the bottom of the tray. Body 300 includes an annular or disc shaped ring or land 306 to engage the upper surface of the tray. A locking ring 308 is configured to rest in a locking ring groove just below the bottom wall of the tray so as to provide for snug fit of fitting 156 to the tray, preventing up and down movement.

A captured upper slide 310 and a captured lower slide 314 are adapted to slide in upper 312*a/b* and lower 316*a/b* slide engaging walls. Upper slide engaging walls 312*a/b* are shaped like an inverted "L" and will frictionally engage the sidewalls of the upper slide. Lower slide engaging walls 316*a/b* are "L"-shaped and designed to frictionally engage the sidewalls of lower captured slide 314. The function of the captured slides is to engage, by sliding back and forth in slide bays 326, dole fittings 320, one coming into the top of fluid fitting 156 from the bag and engaged by upper capture slide 310 and one dole fitting coming into the bottom of body 300 and engaged by lower captured slide 314 in ways set forth below.

Dole fittings 320 are seen to comprise o-ring bays 322 with o-rings 324 therein. There may be two o-ring bays and two o-rings per fitting. Moreover, the o-rings are designed to friction fit with the bore 302 as the dole fittings slide into body 300 as set forth in FIGS. 4 and 5. Further, it can be seen that when both o-rings are seated and dole fittings 320 are seated into body 300, slide bays 326 are adjacent slides 310/314 and movement of the slides 310/314 will carry the slides across the slide bays 326 to lock the dole fittings into body 300. See FIG. 5. Slides 310/314 each have a body 328 having an enlarged space 330 dimensioned to allow dole fittings 320 to pass through and an adjacent narrowed space 332 designed to slide into slide bays 326 of dole fitting 320, see FIG. 5. For further disclosure on the operation of slides and grooves in dole fittings, see U.S. Pat. No. 8,336,736, incorporated herein by reference. Specifically, but without limitation, see elements 460 and 432, FIG. 3 of the '736 reference.

Figure 3:
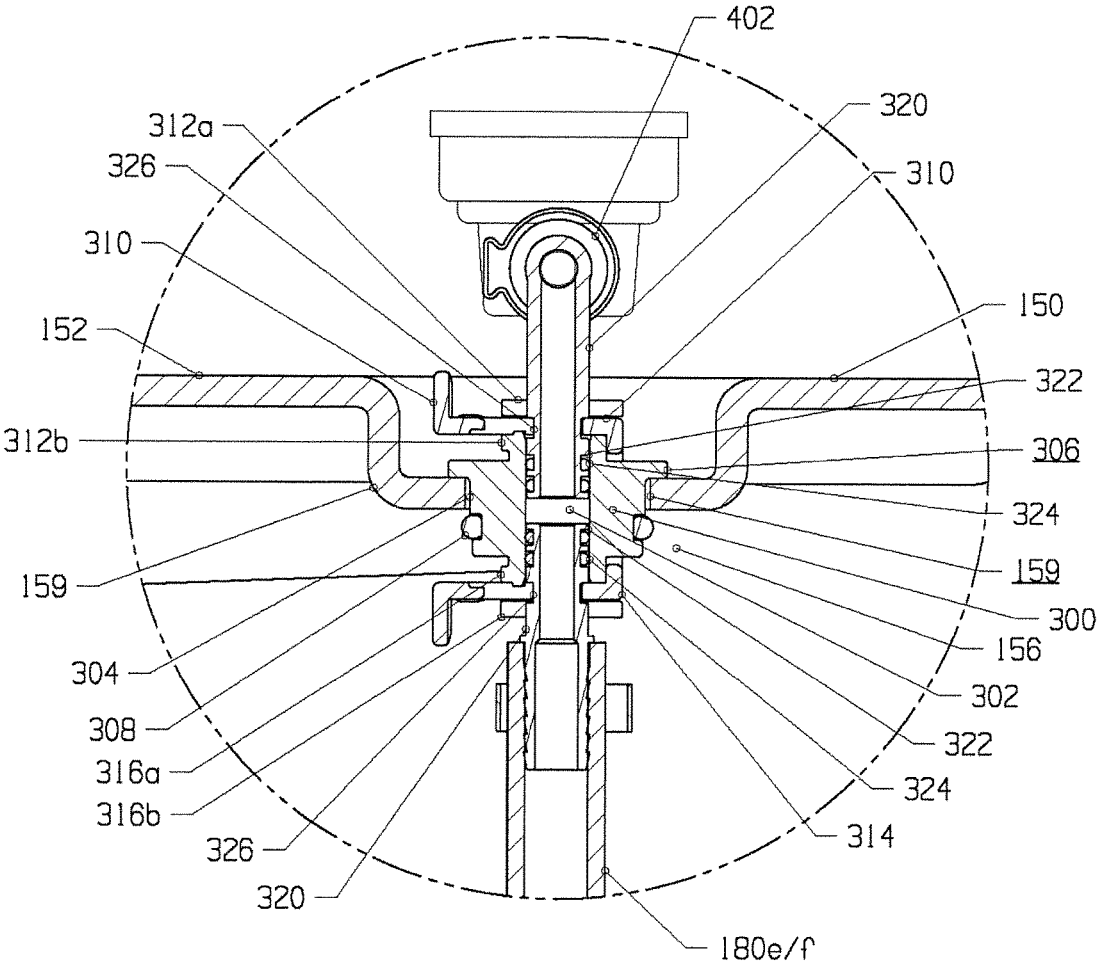
FIGS. 3 and 4 are perspective views cutaway of a tray and a through the tray fluid fitting connector showing the manner in which the fluid connector connects with fittings on the top and bottom to carry fluid in a fluid-type manner through the bottom of the tray and the manner in which the fittings on the top and bottom can be quickly and fluidly coupled and uncoupled from the tray for removal of the tray or removal of the bag from the tray or tray from the housing.
Figure 4:
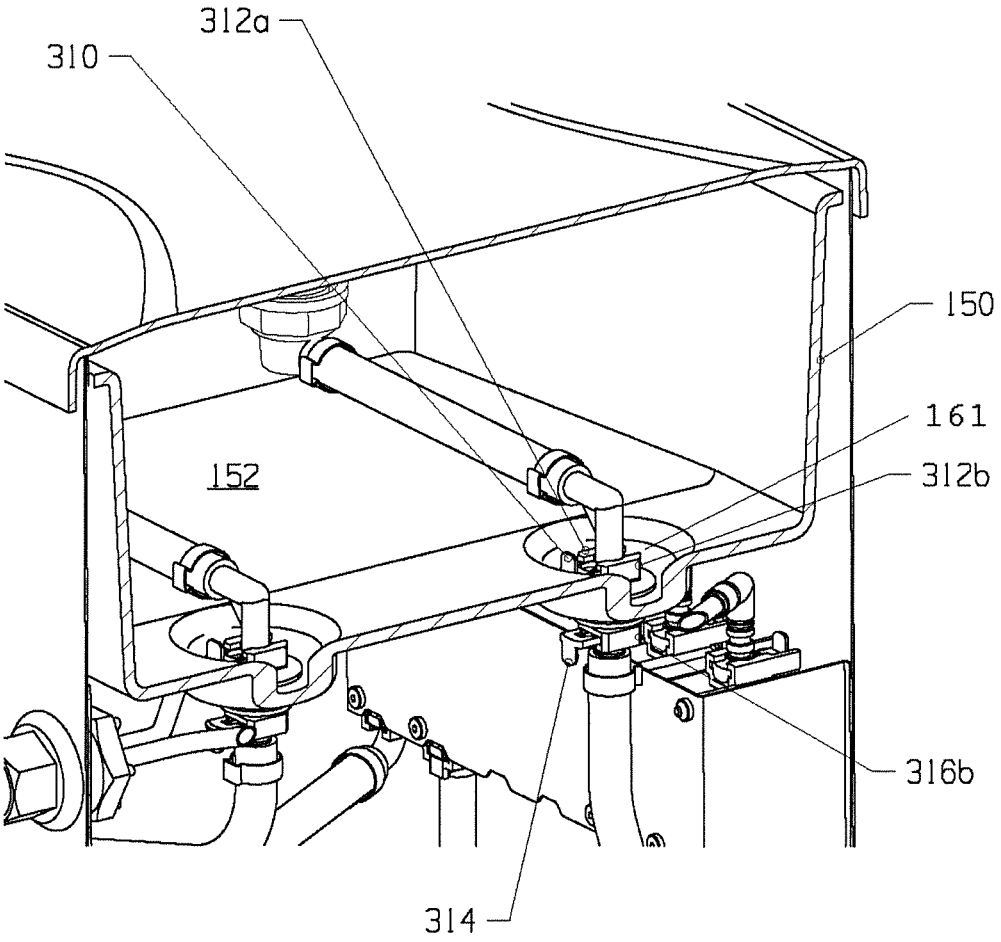
Figure 5A:
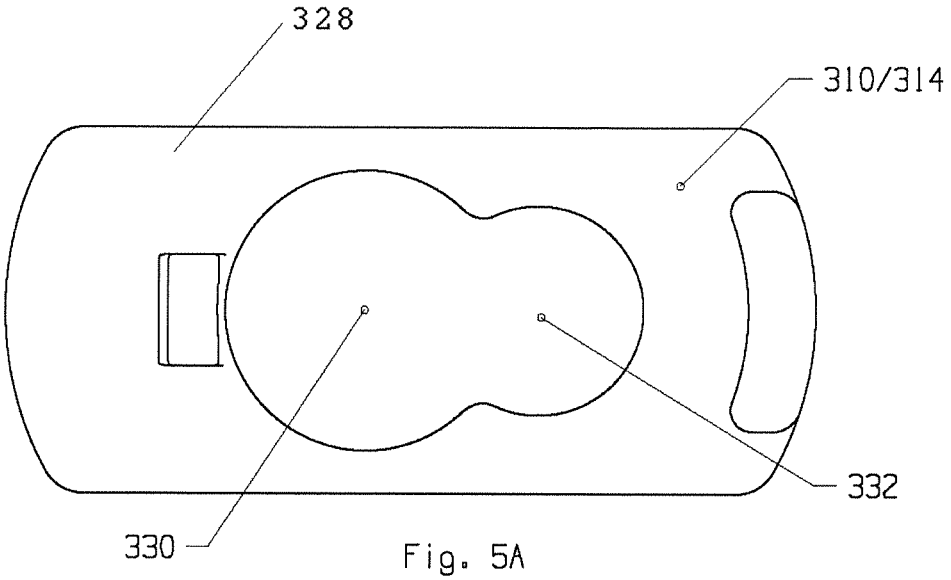
FIG. 5A is a top view of a slide used with the tray bottom and fluid fitting.
Figure 5:
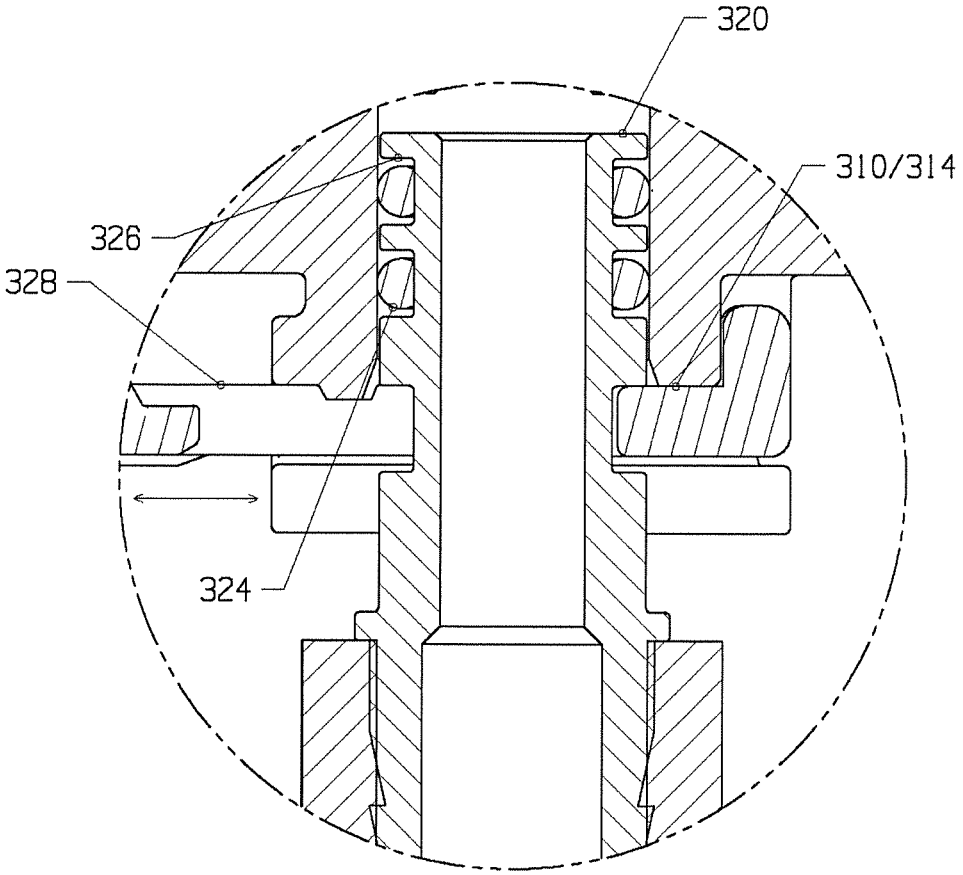
FIG. 5 is a perspective view of the slides used with the tray bottom and fluid fitting.

FIG. 3 illustrates the manner in which a fitting 156 is located in a well 161 in the bottom 152 of tray 150, the well being slightly lower than bottom 152. Moreover, it is seen that well 161 may contain aperture 159. FIGS. 4 and 6 illustrate the manner in which well 161 may be located in an elevated portion 153A of bottom 152 of tray 150. Well 161 allows fitting 156 to extend into tray 150 so that the fitting can be manipulated therein by a user (e.g., to decouple a beverage concentrate bag from the system) while also preventing the fitting from interfering (e.g., snagging, tearing, puncturing, etc.) with the beverage concentrate bag while it is therein.

Fitting 156 is dimensioned to pass through aperture 159. Because the aperture and fitting are at the high-end of the bottom, the bag or bag in box will lay so that its bag connector (see FIG. 4) is at or near the lower and the feed line from the bag connector will go up to where it connects into fitting 156. Further, any liquid in the bag or bag in box will pool adjacent the bag connector because it is in the lower end. This will ensure that suction from the pump carried through fitting 156 and feedline to the bag or bag in box will draw out almost all or all the liquid concentrate from the bag, preventing the trapping of fluid in the bag that may occur if the bottom were flat.

Further, any liquid in the bag or bag in box will pool adjacent the bag connector because it is in the lower end. This will ensure that suction from the pump carried through fitting 156 and the feedline to the bag or bag in box will draw out almost all or all the liquid concentrate from the bag, preventing the trapping of fluid in the bag that may occur if the bottom were flat.

Conduit 402 may be flexible conduit that connects to fitting 156, and the conduits 180*e/f* that attach below the fitting 156 may have enough excess that the tray may be lifted clear of the rim of the housing without interference so a service attendant may disconnect the lower dole fitting and remove the tray. About 10 to 16 inches of "play" should be provided in these lines.

Although the invention has been described with reference to specific embodiments, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

100 Beverage dispensing system
110 Housing
112 Base
114 Vertically extending sidewalls
116 Cavity
120 Water inlet assembly
122 Connector
124 Manifold or divider
130 Flow controller assembly
132 Flow controllers
140 Dispensing faucets or valves
142 Handle
144 Nozzle
150 Beverage storage tray
152 Tray bottom
152*a* A well in bottom
153*a* Tray elevated end
153*b* Tray lower end
153*c* Aperture
154 Sidewalls
156 Quick disconnect fluid connector fitting
157 Lid
159 Aperture
160 Electric pumps
161 Well
170 Pressure switches
180 Conduit
190 Conduit
200 Beverage dispensing system
210 Water supply
220 Water inlet assembly
19
230 Flow controller
240 Dispensing valve
250 Beverage concentrate syrup
260 Pump
261 Wall mount transformer
270 Pressure switch
280 Flow controller
290 Conduits
300 Cylindrical body
302 Central bore
304 Sidewalls
306 Land
308 Locking ring
310 Upper slide
312*a/b* Upper
314 Lower slide
316*a/b* Lower
320 Dole fittings
322 O-ring bays
324 O-rings
326 Slide bays
328 Body
330 enlarged space
332 narrowed space

The invention claimed is:

1. A beverage dispensing system comprising:

a housing with an interior;

a tray with a bottom surface, the tray adapted to fit within the interior;

a bag with concentrate, dimensioned to rest in the tray;

a post-mix valve attached to the outside of the housing;

a through the tray fluid connector fitting engaging the bottom of the tray;

a first fluid circuit for engaging the through the tray fluid connector fitting, the first fluid circuit including a pump, a flow control element, and a conduit, the conduit for engaging the through the tray fluid connector fitting, the first fluid circuit engaging the post-mix valve to provide pressurized beverage concentrate to the post-mix valve;

a second fluid circuit for providing pressurized water to the post-mix valve; and a remote step down transformer for providing 24 volt DC power to the pump of the first circuit.

2. The beverage dispensing system of claim 1, wherein the connector fitting is configured to be coupled and decoupled from the bag while remaining engaged with the tray bottom.

3. A beverage dispensing system for engaging a remote, pressurized water source, a remote source of electricity, and one or more bags of beverage concentrate, the system comprising:

a housing including a base and vertically extending walls that define an interior space with an inner cavity at the top of the interior space of the housing;

a water inlet assembly coupled to the housing and the remote, pressurized water source;

a flexible concentrate conduit for engaging a bag of concentrate;

a tray dimensioned for receipt within the housing, the tray dimensioned for holding at least one of the bags of concentrate;

a post mix dispensing valve having a manually operated handle configured to be grasped by hand, the post mix dispensing valve coupled to the exterior of the housing;

a first fluid circuit including a through the tray fluid connector fitting for removably engaging the flexible concentrate conduit that engages the bag of concentrate, the fluid connector fitting having a central bore, the first fluid circuit including an electric pump and a mechanical flow control element, the electric pump and mechanical flow control element located within the housing, and a downstream conduit removably engaging the through the fluid connector fitting, the first fluid circuit engaging the dispensing valve to carry beverage concentrate thereto; and a second fluid circuit for carrying pressurized water from the water inlet assembly to the dispensing valve;

wherein movement of the handle of the dispensing valve causes simultaneous flow of the fluids of the two fluid circuits and subsequent mixing of the fluids before the mixed fluids are dispensed from the dispensing valve.

4. The beverage dispensing system of claim 3, wherein the second fluid circuit includes a mechanical flow control element located within the housing and conduits engaging the mechanical flow control element of the second fluid circuit, the water inlet assembly, and the dispensing valve.

5. The beverage dispensing system of claim 3, wherein the tray is adapted to be lifted out a top of the housing without the use of tools.

6. The beverage dispensing system of claim 3, wherein the housing is dimensioned to rest on a counter.

7. The beverage dispensing system of claim 3, wherein the electric pump of the first fluid circuit is an AC or DC pump and wherein the beverage dispensing system includes a step down transformer, 8 volts or less, located outside the housing and engaging the remote source of electricity and engaging the electric pump located inside the housing.

8. The beverage dispensing system of claim 3, wherein the downstream conduit has sufficient free play such that the tray may be lifted up to clear the inner cavity without disconnecting the downstream conduit from the fluid connection fitting.

9. The beverage dispensing system of claim 8, wherein the free play is between about 10" and 14".

10. The beverage dispensing system of claim 3, wherein the tray is adapted to couple to the housing and be suspended in the inner cavity about a peripheral rim of the housing, the tray having sidewalls and a bottom that define a tray enclosure dimensioned to hold the bag of concentrate, the bottom including an aperture for receiving the through the tray fluid connector fitting of the first fluid circuit.

11. The beverage dispensing system of claim 10, wherein the bottom of the tray is tilted with respect to a horizontal plane and wherein the aperture is in a higher portion of the bottom of the tray.

12. The beverage dispensing system of claim 10, wherein the fluid connector fitting of the first fluid circuit comprises a first toolless, fluid tight coupling assembly for engaging the flexible concentrate conduit from the bag of concentrate to the through the tray fluid connector fitting.

13. The beverage dispensing system of claim 12, further including a second toolless, fluid tight coupling assembly for engaging the downstream conduit.

14. A beverage dispensing system for engaging a remote, pressurized water source, a remote source of electricity, and one or more bags of concentrate, the system comprising:

a housing including a base and vertically extending walls that define an interior space with an inner cavity at the top of the interior space of the housing;

a water inlet assembly coupled to the housing and the remote, pressurized water source;

a tray having a bottom, the tray dimensioned for receipt within the housing, the tray dimensioned for holding at least one of the bags of concentrate;

a post mix dispensing valve having a handle, the post mix dispensing valve coupled to the exterior of the housing;

a first fluid circuit including a through the tray fluid connector fitting for engaging the bag of concentrate, the fluid connector fitting having a central bore, the first fluid circuit including an electric pump and a mechanical flow control element, the electric pump and mechanical flow control element located within the housing, and a downstream conduit engaging fluid connector fitting, the first fluid circuit engaging the dispensing valve to carry beverage concentrate thereto; and a second fluid circuit for carrying pressurized water from the water inlet assembly to the post mix dispensing valve, the second fluid circuit including a mechanical flow control element located within the housing and downstream conduits engaging the mechanical flow control element, the water inlet assembly, and the dispensing valve;

wherein movement of the handle of the dispensing valve causes simultaneous flow of the fluids of the two fluid circuits and subsequent mixing of the fluids before the mixed fluids are dispensed from the dispensing valve;

wherein the tray is adapted to lift out a top of the housing without the use of tools; and wherein the bottom of the tray is tilted with respect to a horizontal plane and wherein an aperture of the beverage concentrate bag is in a lower portion of the bottom of the tray.

15. The beverage dispensing system of claim 14, wherein the electric pump of the first fluid circuit is either an AC or DC pump and wherein the beverage dispensing system includes a step down transformer, about 24 volts or less, located outside the housing and engaging the remote source of electricity and engaging the electric pump located inside the housing.

16. The beverage dispensing system of claim 15, wherein the housing is dimensioned to rest on a counter.

17. The beverage dispensing system of claim 14, wherein the through the tray fluid connector fitting includes a first toolless fluid tight coupling assembly for engaging a bag of concentrate.

18. The beverage dispensing system of claim 17, further including a second toolless, fluid tight coupling assembly for coupling the downstream conduit to the electric pump of the first fluid circuit.

* * * * *